US006799639B2

(12) United States Patent
Sato et al.

(10) Patent No.: US 6,799,639 B2
(45) Date of Patent: Oct. 5, 2004

(54) HORIZONTAL SIDEWALL SPRINKLER HEAD

(75) Inventors: Koki Sato, Iwate (JP); Satoshi Oba, Iwate (JP)

(73) Assignee: Senju Sprinkler Company Limited, Tokyo (JP)

( * ) Notice: Subject to any disclaimer, the term of this patent is extended or adjusted under 35 U.S.C. 154(b) by 38 days.

(21) Appl. No.: 10/317,102

(22) Filed: Dec. 12, 2002

(65) Prior Publication Data

US 2003/0111237 A1 Jun. 19, 2003

(30) Foreign Application Priority Data

| | | |
|---|---|---|
| Dec. 14, 2001 | (JP) | 2001-381287 |
| Dec. 14, 2001 | (JP) | 2001-381288 |
| Jul. 26, 2002 | (JP) | 2002-217425 |
| Aug. 22, 2002 | (JP) | 2002-241894 |

(51) Int. Cl.[7] ..... A62C 37/08; A62C 37/36; A62C 37/12; B05B 1/26

(52) U.S. Cl. ..... 169/37; 169/42; 169/57; 239/498; 239/504; 239/509; 239/521; 239/522

(58) Field of Search ..... 169/37, 42, 57, 169/38–41, 56; 239/498, 504, 509, 521, 522, 209, 502, 505–507, 518, 520, 523, 524

(56) References Cited

U.S. PATENT DOCUMENTS

| | | | |
|---|---|---|---|
| 4,296,815 | A | 10/1981 | Mears |
| 4,296,816 | A | 10/1981 | Fischer |
| 4,804,046 | A | 2/1989 | Capasso |
| 4,987,957 | A | 1/1991 | Galaszewski |
| 5,722,599 | A | 3/1998 | Fries |
| 5,727,737 | A | 3/1998 | Bosio et al. |
| 5,810,263 | A | 9/1998 | Tramm |
| 6,098,718 | A | 8/2000 | Sato |
| 6,367,559 | B1 | 4/2002 | Winebrenner |

FOREIGN PATENT DOCUMENTS

| | | |
|---|---|---|
| JP | 60-195055 | 12/1985 |
| JP | 5-24058 | 3/1993 |
| JP | 2001-340487 | 12/2001 |
| JP | 2002-58752 | 2/2002 |

*Primary Examiner*—Michael Mar
*Assistant Examiner*—Darren Gorman
(74) *Attorney, Agent, or Firm*—Wenderoth, Lind & Ponack, L.L.P.

(57) ABSTRACT

A horizontal sidewall sprinkler head includes a tubular body with an inlet opening communicated with a source of water and an outlet opening normally closed by a valve member, and a cylindrical frame connected to the body. A deflector is disposed in the frame and is movable between retracted and extended positions. A thermally responsive assembly is mounted to the frame to urge the valve member in sealing engagement with the outlet opening. The thermally responsive assembly is activated to release the valve member when the ambient temperature exceeds a predetermined value. A deflector guide includes a ring movably disposed within the frame, a pair of parallel struts axially extending from the ring, and a pair of parallel stabilizer arms axially extending from the outer periphery of the ring. The stabilizer arms have a proximal end connected to the ring, a distal end and an elongate intermediate portion extending between the two ends. The intermediate portion has an area less than that of the distal end.

18 Claims, 14 Drawing Sheets

HORIZONTAL SIDEWALL SPRINKLER HEAD

BACKGROUND OF THE INVENTION

The present invention generally relates to a sprinkler head for use in a side wall mount and more particularly, to a deflector guide for use in such a horizontal sidewall sprinkler head.

A typical horizontal sidewall sprinkler head is disclosed in U.S. Pat. No. 6,098,718 issued to Koki Sato. The prior art sidewall sprinkler head includes a housing within which a deflector in the form of a contoured plate is normally disposed. The deflector is urged out of the housing to discharge water or other fire extinguishing liquid in a predetermined pattern when a fire is sensed. To ensure that the deflector is moved from its retracted position to extended position, a deflector guide is received within the housing. The deflector guide includes a ring movably fitted within the housing, and a pair of diametrically opposite struts extending through the deflector and secured to the ring. If a ring is not properly slid along the inner peripheral surface of the housing, the deflector may not smoothly be moved out of the housing.

Accordingly, it is an object of the present invention to provide a horizontal sidewall sprinkler head which allows a deflector to be safely moved along the axis of the sprinkler head and thus, smoothly moved out of a sprinkler frame or housing.

It is another object of the present invention to provide a horizontal sidewall sprinkler head which produces improved distribution of fire extinguishing liquid in a region to be protected.

SUMMARY OF THE INVENTION

According to one aspect of the present invention, there is provided a horizontal sidewall sprinkler head including a tubular body having an inlet opening adapted to communicated with a source of fire extinguishing liquid and an opposite, outlet opening normally closed by a valve member, and a cylindrical frame fluidly connected to the tubular body. A deflector is movable between a retracted position wherein the deflector is positioned within the frame and an extended position wherein the deflector is urged out of the frame. The deflector is configured to discharge the fire extinguishing liquid radially outwardly from the axis of the frame when the deflector is moved to its extended position. A trigger or thermally responsive assembly is mounted to the frame to normally urge the valve member in sealing engagement with the outlet opening. The thermally responsive assembly is activated to release the valve member from the outlet opening when the ambient temperature exceeds a predetermined value.

In order to guide the deflector between its retracted and extended positions, there is provided a deflector guide which includes a ring movably disposed within the frame, a plurality of parallel guide struts axially extending from the ring and adapted to allow the deflector to move generally along the axis of the frame, and a plurality of parallel stabilizer arms axially extending from the outer periphery of the ring and adapted to allow the ring to slidably move generally along the axis of the frame. Each of the stabilizer arms has a proximal end connected to the ring, a distal end and an elongate intermediate portion extending between the two ends. As a feature of the present invention, the intermediate portion has an area less than that of the distal end. In one embodiment, the stabilizer arms each have inclined upper and lower transitional portions between the intermediate portion and the distal end. Alternatively, the stabilizer arms may have curved upper and lower transitional portions between the intermediate portion and said distal end. Still alternatively, the stabilizer arms may have a generally rectangular shape. In such a case, the intermediate portion of the stabilizer arms may have an elongate opening through which the fire extinguishing liquid passes.

A blade member may be connected to the frame and located above the deflector when the deflector is moved to its extended position. In one embodiment, the blade member includes an upright portion secured to the frame, and a canopy portion generally horizontally extending from the upper end of the upright portion. To increase the upward trajectory of the fire extinguishing liquid, the canopy portion of the blade member may have a round free edge. Similarly, the canopy portion may have upwardly bent opposite front corners.

The above and other objects, advantages and features of the present invention will become apparent from a reading of the following detailed description of the invention when taken in conjunction with the accompanying drawings.

DETAILED DESCRIPTION OF THE INVENTION

Figure 1:
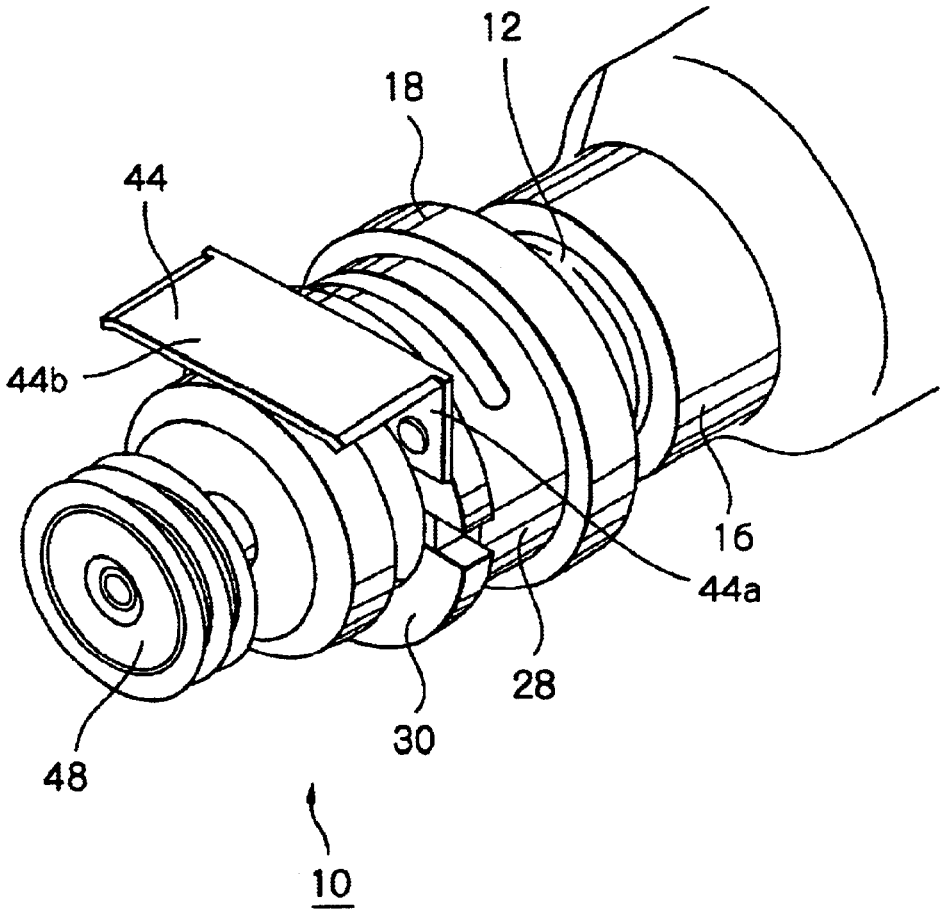
FIG. 1 is a perspective view of a horizontal sidewall sprinkler head assembled according to one embodiment of the present invention.

Throughout the several views of the drawing, like parts are given like reference numerals.

Figure 2:
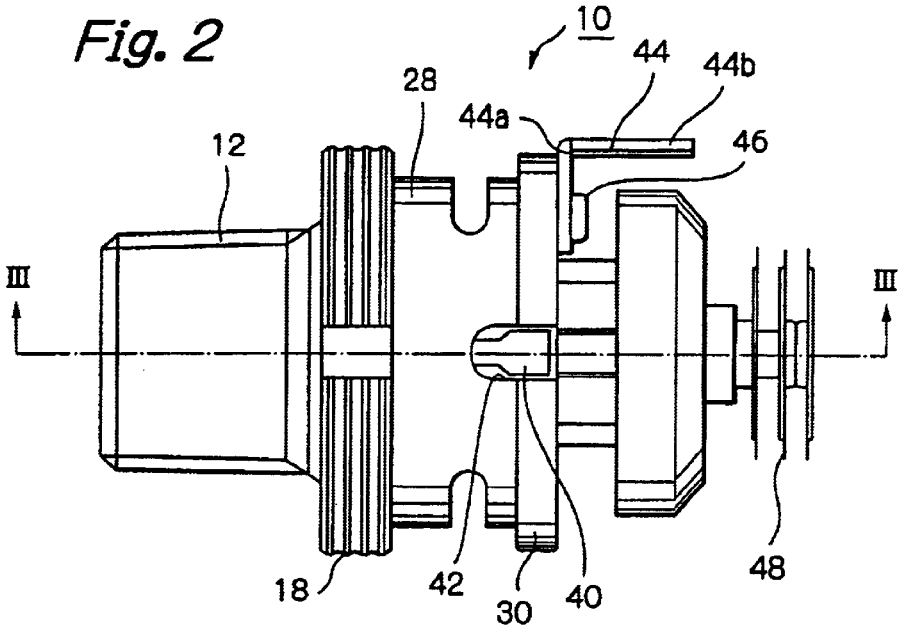
FIG. 2 is a side view of the horizontal sidewall sprinkler head shown in FIG. 1.
Figure 3:
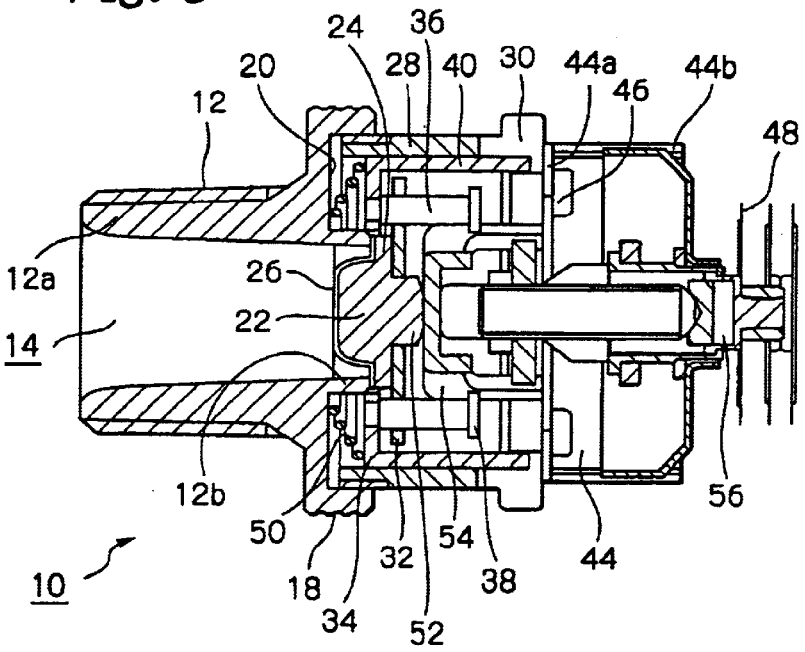
FIG. 3 is a sectional view taken on the line III—III in FIG. 2.

Referring first to FIGS. 1 to 3, there is illustrated a horizontal sidewall sprinkler head assembled according to one embodiment of the present invention and generally designated by the numeral 10. The horizontal sidewall sprinkler head 10 includes an externally threaded tubular body 12 with an inlet opening 12*a* and a projected outlet opening 12*b*. An internal passage 14 is defined in the tubular body 12 and extends between the two openings 12*a*, 12*b*. An internally threaded fitting 16 is fitted over the inlet opening 12*a* of the tubular body 12. The internal passage 14 of the tubular body 12 is fluidly connected to a water supply line (not shown) through the fitting 16. An externally threaded cylindrical end flange 18 extends radially outwardly from the outlet opening 12*b* of the body 12. An annular cavity 20 is formed between the end flange 18 and the outlet opening 12*b* of the body 12. An internally threaded cylindrical mount (not shown) is threadably secured around the end flange 18 to mount the horizontal sidewall sprinkler head 10 on the vertical side wall of a room or structure being protected, typically at a location near the ceiling. The outlet opening 12*b* of the tubular body 12 serves as a valve seat for a valve element The valve element 22 has an annular flange 24 which normally seats against the outlet opening 12*b* of the tubular body 12. A suitable gasket 26 is attached to the bottom of the valve element 22 to tightly seal the outlet opening 12*b* of the tubular body 12.

Figure 4:
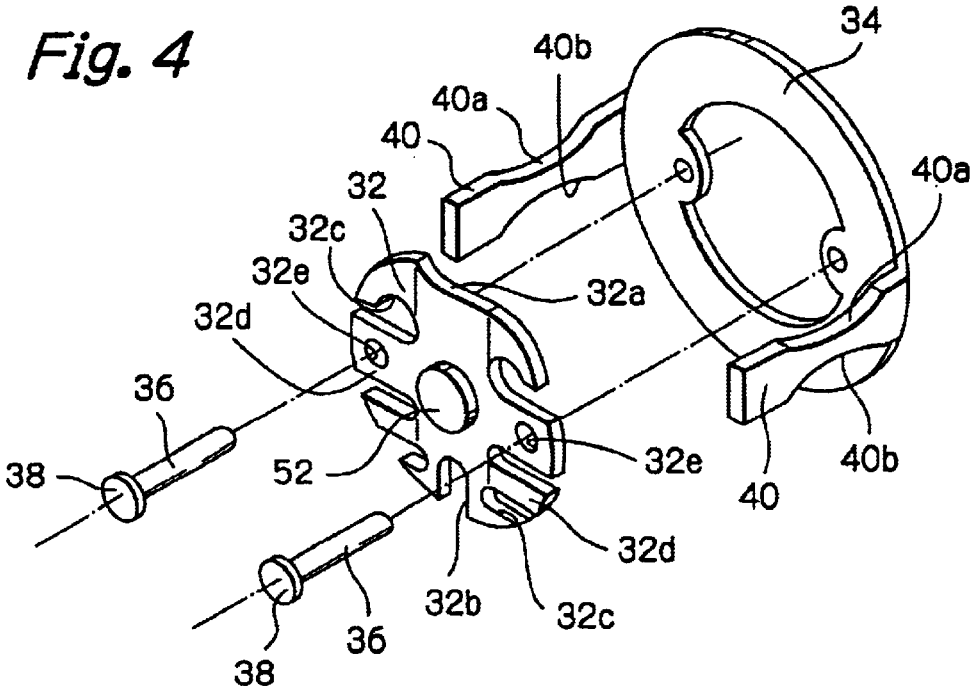
FIG. 4 is an exploded perspective view of a deflector and a deflector guide used in the horizontal sidewall sprinkler head shown in FIG. 1.
Figure 5:
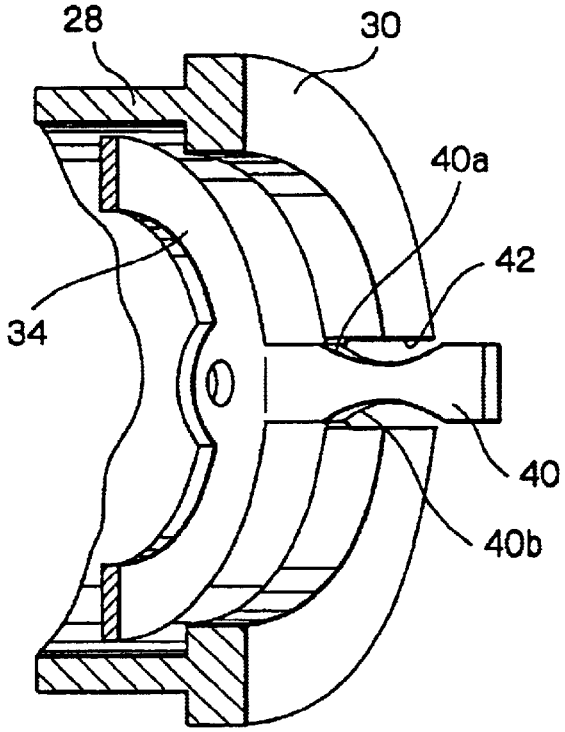
FIG. 5 is an enlarged cutaway view showing the manner in which stabilizer arms of the deflector guide are moved through a flange.

A generally cylindrical frame 28 is secured to the end flange 18 and is formed at its one end opposite the end flange 18 with an annular flange 30. A deflector 32 is secured to the valve element 22. The deflector 32 is moved between a retracted position (see FIG. 3) wherein the deflector 32 is positioned within the frame 28 and an extended position (see FIG. 7) wherein the deflector 32 is urged out of the frame 28. As shown in FIG. 4, the deflector 32 is formed with an arcuate top recess 32*a* and an elongated bottom recess 32*b*. A variety of side slots 32*c* are defined in lateral sides of the deflector 32 to provide a plurality of slightly rearwardly bent side tines 32*d*. To properly move the deflector 32 out of the frame 28 when a fire is sensed, there is provided a means (deflector guide) for guiding the deflector 32. The deflector guide includes an annular ring 34 movably disposed within the frame 28 and normally contacted with the deflector 32, and a pair of diametrically opposite parallel guide pins or struts 36 secured to one side of the ring 34. The guide struts 34 extend through respective apertures 32*e* which are defined in one pair of side tines 32*d*. The guide struts 36 each have an enlarged end 38 to limit outward movement of the deflector 32. As better shown in FIG. 5, the flange 30 of the frame 28 extends both radially inwardly and outwardly from the free end of the frame 28. Outward movement of the ring 34 is stopped when the ring 34 comes into contact with the flange 30. To allow the ring 34 to move generally along the axis of the frame 28, a pair of diametrically opposite parallel stabilizer arms 40 extend from the outer periphery of the ring 34 and are located adjacent to the guide struts 36. The distance between the two stabilizer arms 40 are only slightly less than the inner diameter of the frame 28. To allow the stabilizer arms 40 to move through the flange 30, a pair of diametrically opposite recesses 42 radially extend through the flange 30.

Referring back to FIGS. 1 to 3, a L-shaped auxiliary deflector or blade member 44 includes an upright portion fixedly secured to the upper section of the flange by screws 46 and a planar canopy portion 44*b* extending generally horizontally from the upper end of the upright portion 44*a*. A thermally responsive assembly 48 is releasably attached to the flange 30 of the frame 28 so as to urge the valve element 22 into its closed position against the bias of a compression spring 50. The compression spring 50 is disposed between the bottom of the annular cavity 20 and the ring 34. The valve element 22 has a cylindrical central projection 52 which extends through the deflector 52. The thermally responsive assembly 48 includes a retainer 54. The retainer 54 is held in contact with the projection 52 of the valve element 22 when the deflector 32 is kept in its retracted or non-activated position as best shown in FIG. 3.

Figure 6:
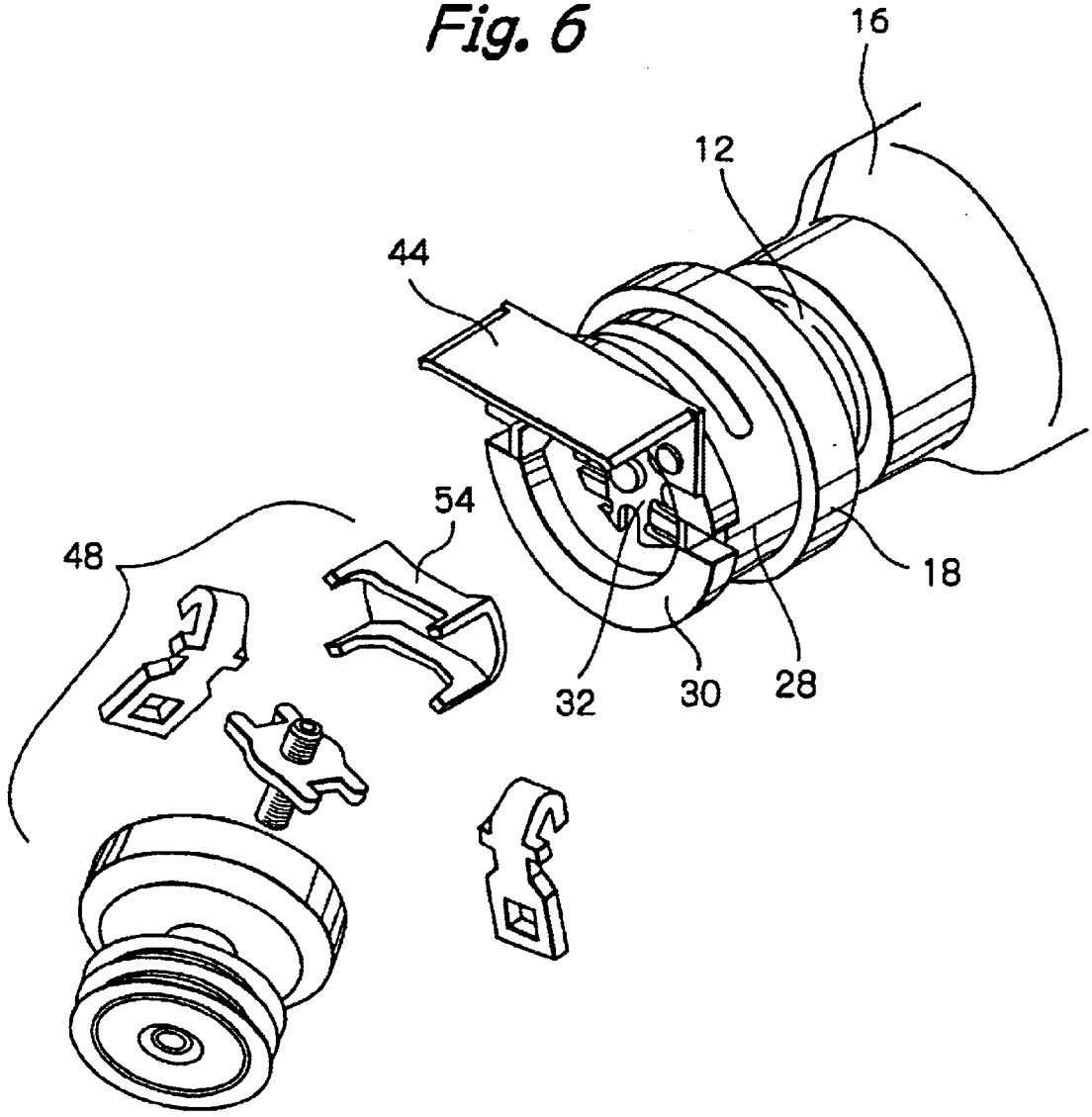
FIG. 6 is a perspective view of the horizontal sidewall sprinkler head when activated by disintegration of a thermally responsive assembly.
Figure 7:
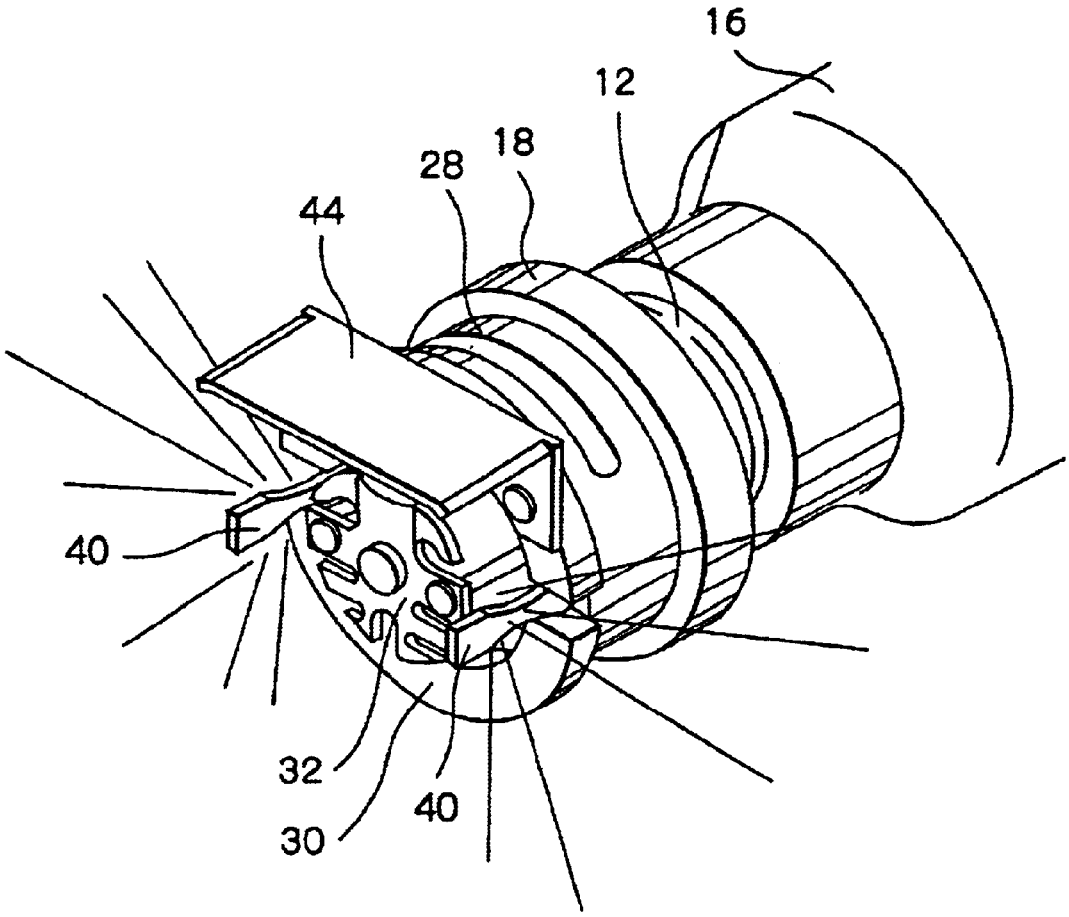
FIG. 7 is a perspective view of the horizontal sidewall sprinkler head, showing the manner in which the deflector and the stabilizer arms are operatively associated with one another to discharge water radially outwardly from the axis of the sprinkler head.

In operation, the horizontal sidewall sprinkler head 10 is activated by disintegration of the thermally responsive assembly 48 due to fusing of a solder 56, as shown in FIG. 6, when the ambient temperature exceeds a predetermined value. As a result, the ring 32 is urged toward the flange 30 of the frame 28 under the action of the compression spring 50. This movement continues until the ring 34 is contacted with the flange 30. At this time, the valve element 22 is unseated from the discharged end 12*a* of the tubular body 12. This allows water or other fire extinguishing liquid to flow into the frame and then, urge the deflector 32 out of the frame 28 as shown in FIG. 7. The water is directed against the deflector 32 and the blade member 44 for distribution over a room (not shown) to be protected. More specifically, the canopy portion 44*b* of the blade member 44 controls the distribution of water at the far wall and far floor area of the room. The deflector 32 causes water to be directed at the near wall and adjacent floor area of the room. It should be noted that rectangular stabilizer arms used in the prior art tend to obstruct the lateral path of water after the water is reflected from the back of a deflector. In the embodiment shown in FIGS. 1 to 7, each of the stabilizer arms 40 has top and bottom recesses 40*a*, 40*b*, intermediate its length. This configuration allows a sufficient amount of water to be distributed in the lateral direction of the sprinkler head 10.

Figure 8:
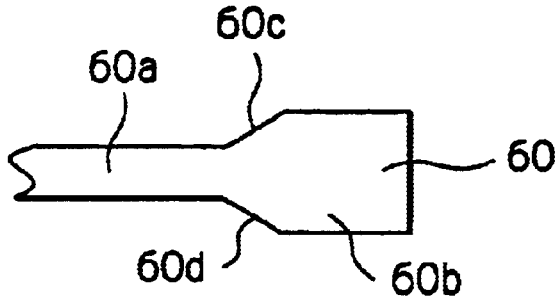
FIGS. 8 to 11 are partial views of modified forms of the stabilizer arms.
Figure 9:
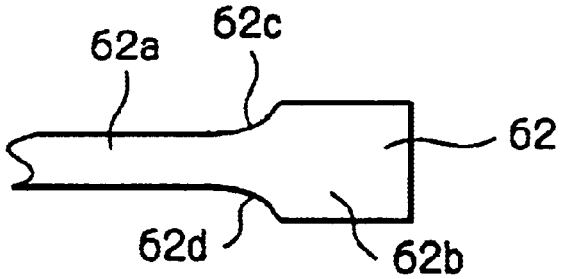
Figure 10:
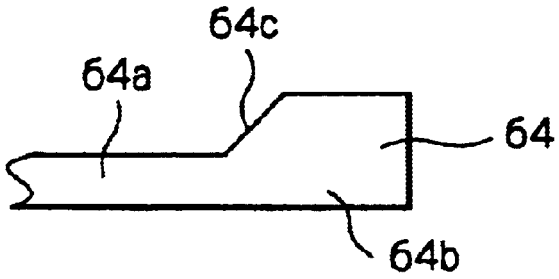
Figure 11:
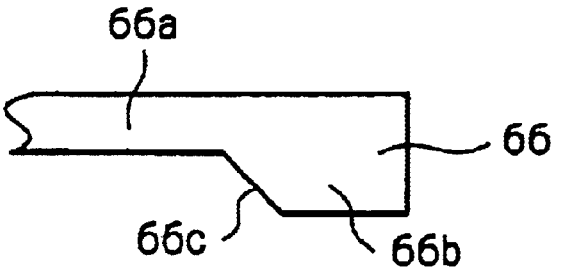
Figure 12:
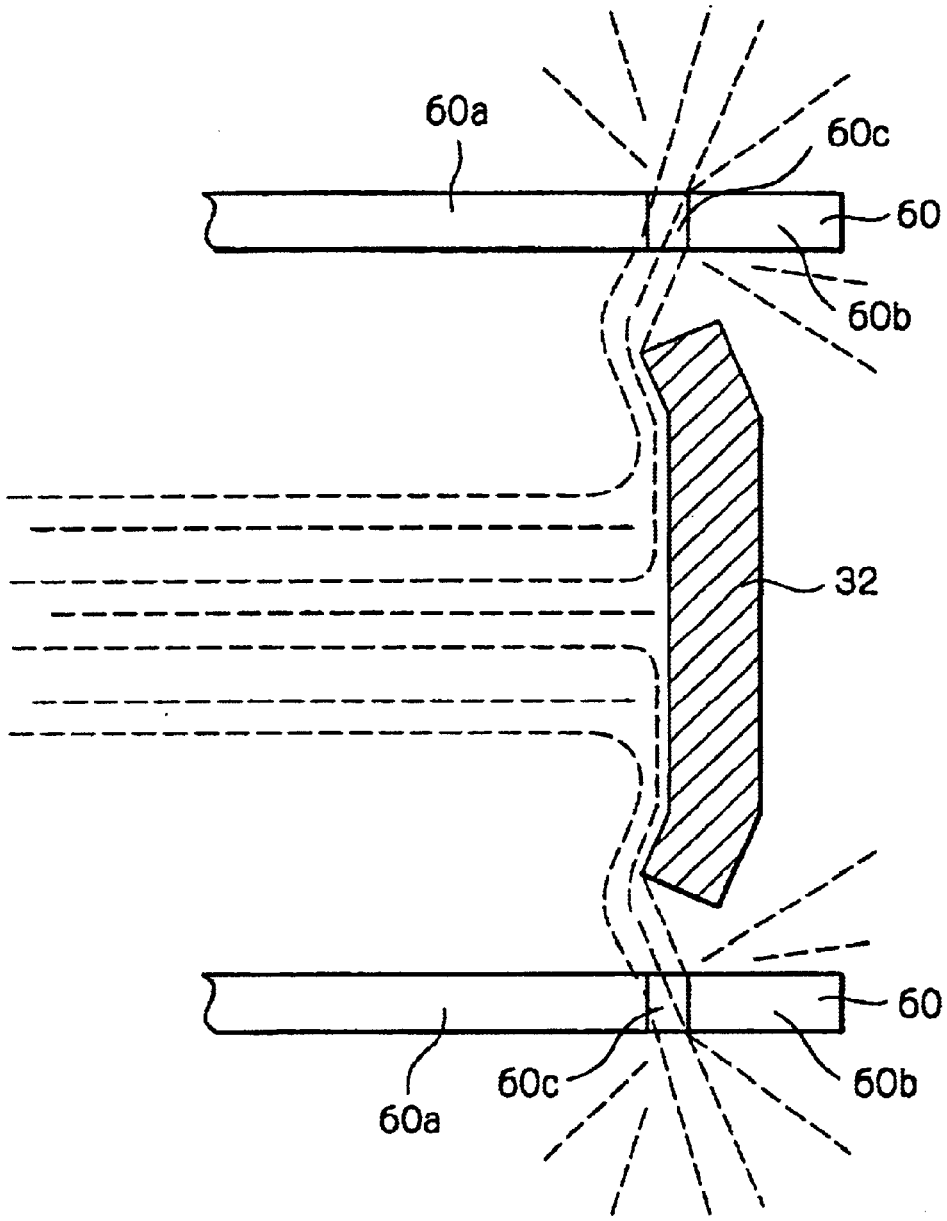
FIG. 12 shows the manner in which the stabilizer arms radially outwardly deflects water reflected from the back of the deflector.
Figure 13:
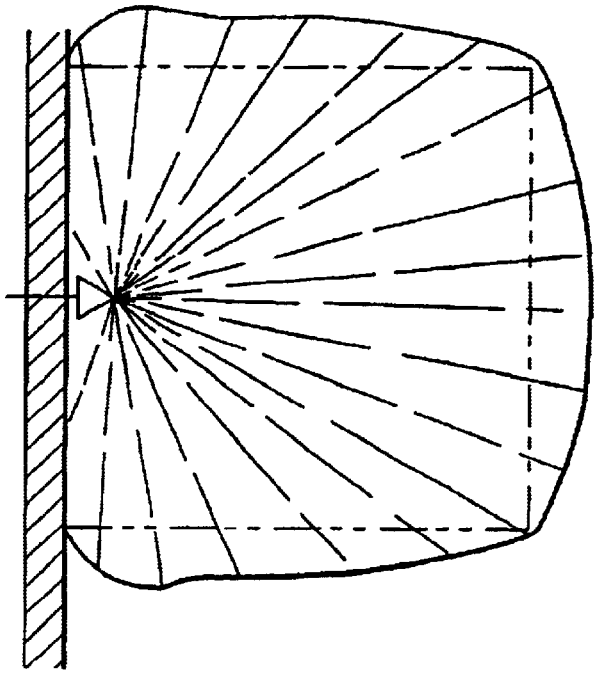
FIG. 13 is a plan view of a water distribution pattern according to the present invention.
Figure 14:
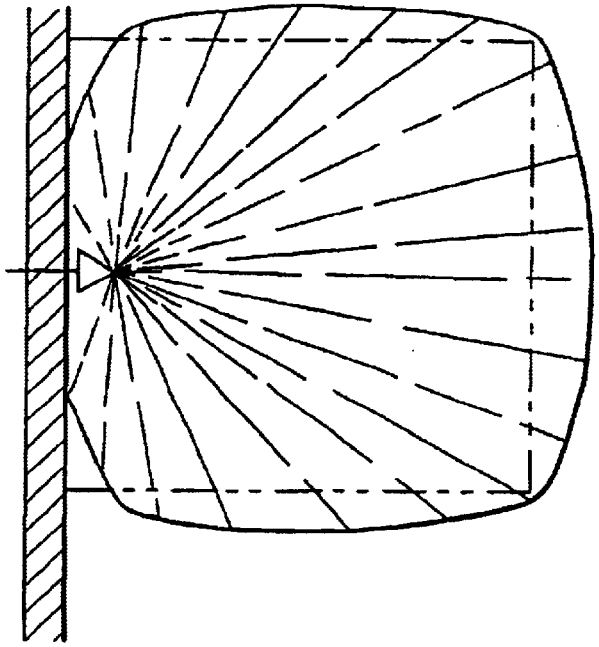
Fig. 14 PRIOR ART
FIG. 14 is a plan view of a water distribution pattern in the prior art.

FIGS. 8 to 11 show modified forms of the stabilizer arms 40 of the deflector guide. As shown in FIG. 8, an arm 60 has a narrow elongate intermediate portion 60*a* and wide opposite ends 60*b* (only one is shown) connected to the intermediate portion 60*a* via inclined upper and lower transitional portions 60*c*, 60*d*. In FIG. 9, an arm 62 has a narrow elongate intermediate portion 62*a* and wide opposite ends 62*b* (only one is shown) connected to the intermediate portion 62*a* via curved upper and lower transitional portions 62*c*, 62*d*. In FIG. 10, an arm 64 has a narrow elongate intermediate portion 64*a* and wide opposite ends 64*b* (only one is shown) connected to the intermediate portion 64*a* via an inclined upper transitional portion 64*c*. Similarly, an arm 66 shown in FIG. 11 has a narrow elongate intermediate portion 66*a* and wide opposite ends 66*b* (only one is shown) connected to the intermediate portion 66*a* via an inclined lower transitional portion 66*c*. The transitional portions of the stabilizer arms form steps. As shown in FIG. 12, the steps 60*a*, 60*d* serve to widely deflect water reflected back from the deflector 32. This allows the water to be directed toward the near corners of the adjoining wall of a room to which the sprinkler head 10 is mounted, as shown in FIG. 13. FIG. 14 shows the manner in which water is distributed when prior art rectangular stabilizer arms are used.

Figure 15:
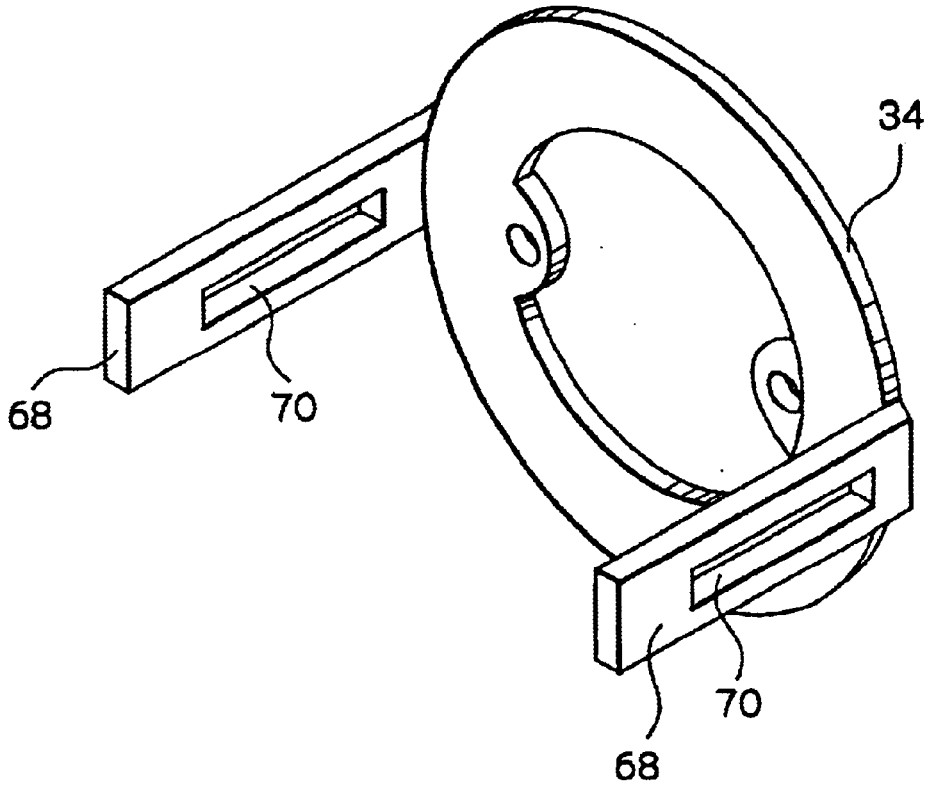
FIG. 15 is an enlarged perspective view of a modified form of the stabilizer arms.

The shape and configuration of the stabilizer arms are not limited to those shown in FIGS. 1 to 11 so far as the intermediate portions of the stabilizer arms are less in area than their opposite ends. For example, as shown in FIG. 15, an arm 68 may take a rectangular shape throughout its length if an elongate opening 70 is formed in its intermediate portion to allow the passage of water therethrough.

Figure 16:
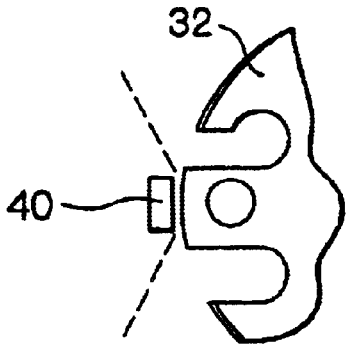
FIG. 16 is a front view of the horizontal sidewall sprinkler head with modified stabilizer arms.
Figure 17:
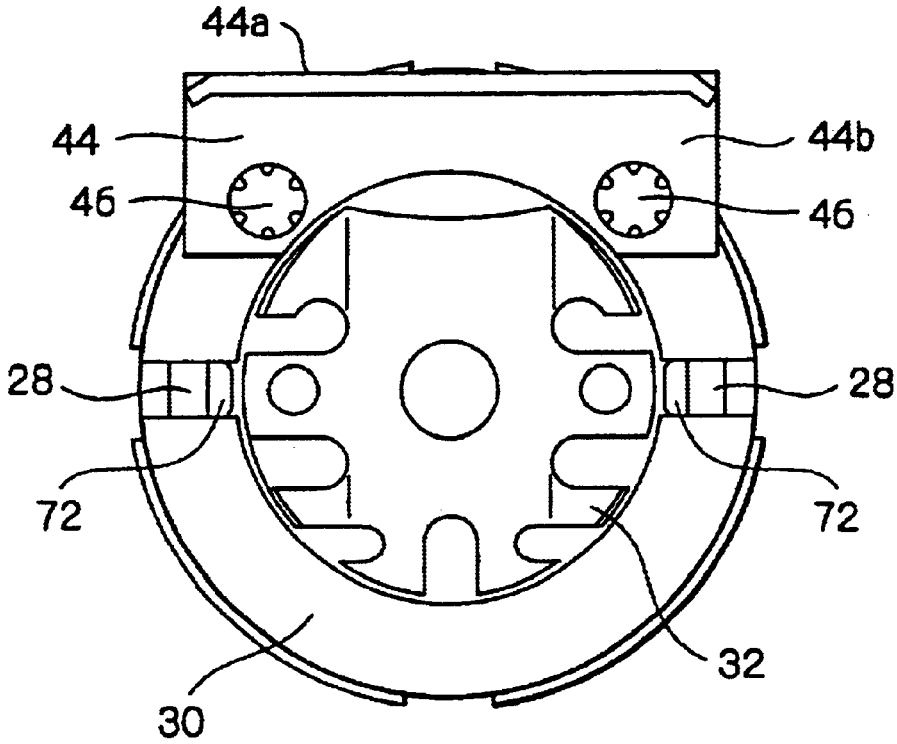
FIG. 17 shows the manner in which water is deflected by the round inner longitudinal edges of the stabilizer arms shown in FIG. 16.
Figure 18:
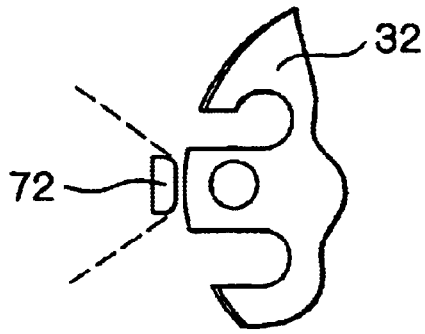
FIG. 18 shows the manner in which water is deflected by the right-angled inner longitudinal edges of the stabilizer arms.

As shown in FIG. 16, each of the stabilizer arms 40 has right-angled upper and lower inner longitudinal edges. As shown in FIG. 17, stabilizer arms 72 may have round upper and lower inner longitudinal edges. As plotted in FIGS. 16 and 18, the round inner edges of the stabilizer arms 70 can distribute water farther in the lateral direction of the sprinkler head 10 than the right-angled inner edges of the stabilizer arms 40.

Figure 19:
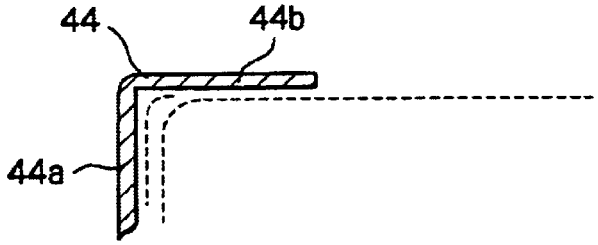
FIG. 19 shows the manner in which water is deflected by a blade member shown in FIG. 1.
Figure 20:
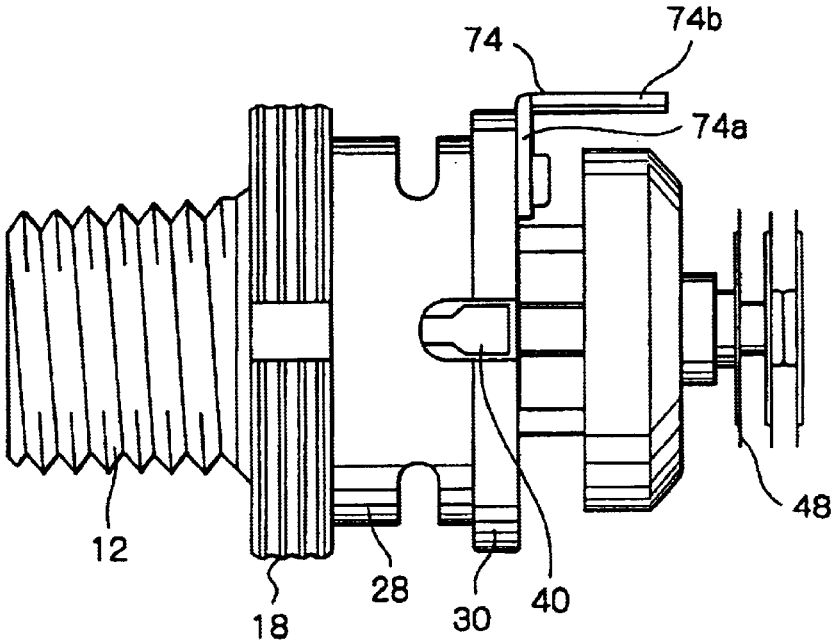
FIG. 20 is a view similar to that of FIG. 2, but showing the round front edge of a blade member.
Figure 21:
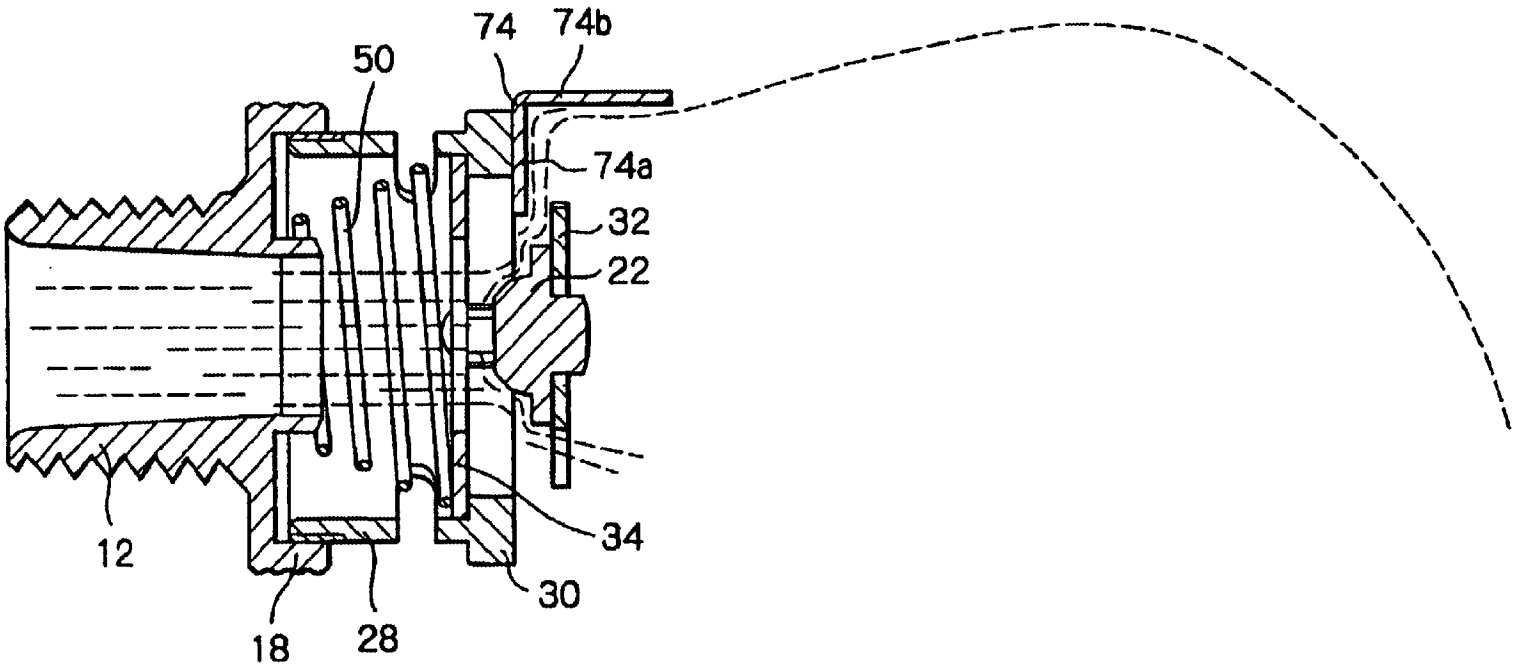
FIG. 21 is a sectional view of the horizontal sidewall sprinkler head, showing the manner in which water is upwardly deflected by the blade member shown in FIG. 20.

The canopy portion 44*b* of the blade member 44 shown in FIGS. 1 to 3 has a straight front edge. This straight front edge substantially limits the upward trajectory of water as plotted in FIG. 19. Referring to FIG. 20, a blade member 74 includes an upright portion 74*a* and a canopy portion 74*b* extending horizontally from the upper end of the upright portion 74*a*. The canopy portion 74*b* has a round front edge. Advantageously, this round front edge increases the upward trajectory of water discharged from the sprinkler head as plotted in FIG. 21 and thus, enables the water to be delivered farther in the longitudinal axis of the sprinkler head than the straight front edge of the canopy portion 44*b* of the blade member 44.

Figure 22:
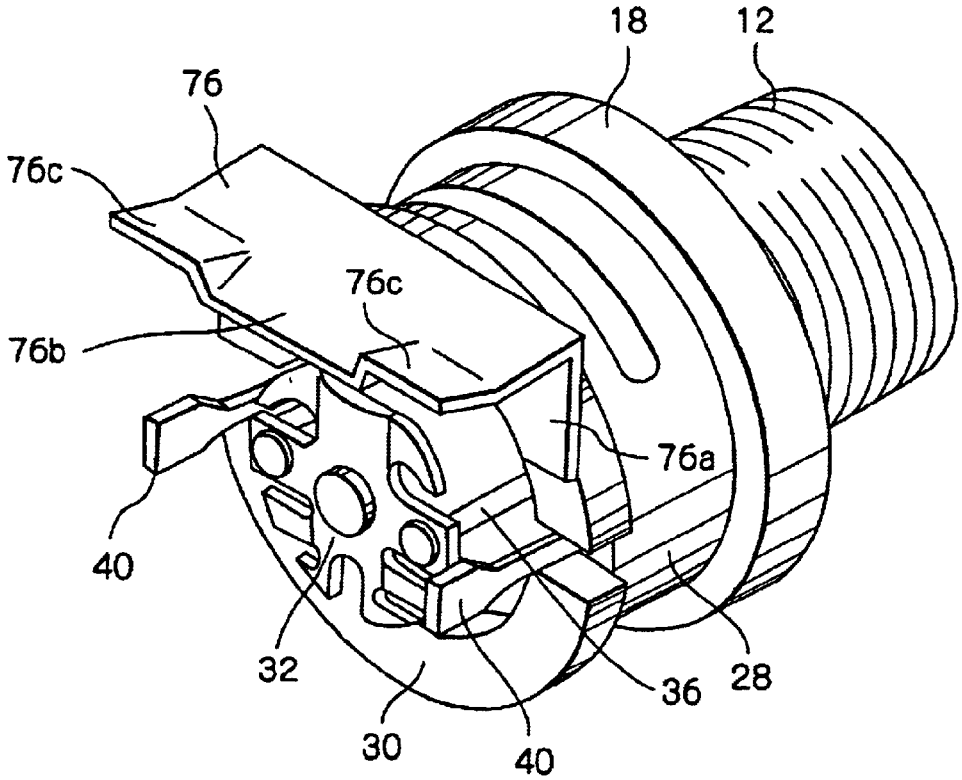
FIG. 22 is a perspective view of the horizontal sidewall sprinkler head with a modified blade member.
Figure 23:
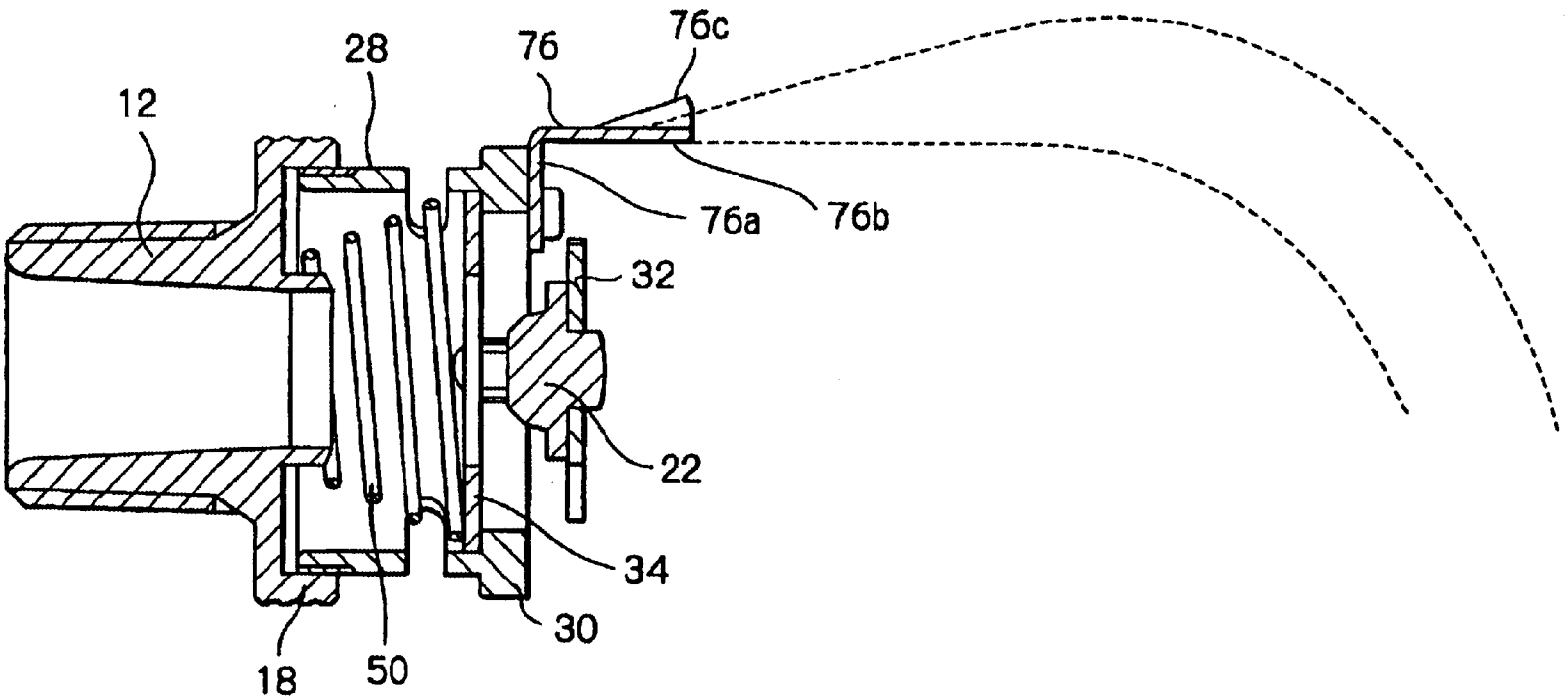
FIG. 23 is a sectional view of the horizontal sidewall sprinkler head, showing the manner in which water is upwardly deflected by the blade member shown in FIG. 22.

FIG. 22 shows a modified form of the blade member. Specifically, a blade member 76 has an upright portion 76*a* secured to the upper section of the flange 30 of the frame 28, and a canopy portion 76*b* extending from the upper end of the upright portion 76*a*. The blade member 76 differs from the blade member 44 shown in FIGS. 1 to 3 in that opposite front corners 76*c* are bent in an upward direction. As shown in FIG. 23, the upwardly bent front corners 76*c* effectively direct water toward corners of a room most remote from the sprinkler head.

Although the present invention has been described with respect to its preferred embodiments, it is to be understood that various modifications and changes may be made without departing from the scope of the invention as defined by the appended claims.

What is claimed is:

1. A horizontal sidewall sprinkler head comprising:

a housing having an inlet opening adapted to be connected to a source of fire extinguishing liquid, an outlet opening and an internal passage extending between said inlet and outlet openings, said housing having an axis;

a deflector movable between a retracted position wherein said deflector is positioned within said housing and an extended position wherein said deflector is urged out of said housing, said deflector being configured to discharge the fire extinguishing liquid radially outwardly from the axis of said housing when said deflector is moved to its extended position;

a closure member for sealing said outlet opening;

a trigger assembly mounted to said housing to normally urge said closure member in sealing engagement with said outlet opening, said trigger assembly being activated to release said closure member from said outlet opening when an ambient temperature exceeds a predetermined value; and a deflector guide including a ring movably disposed within said housing and having an outer periphery, a plurality of parallel guide struts axially extending from said ring and adapted to allow said deflector to move generally along the axis of said housing, and a plurality of parallel stabilizer arms axially extending from the outer periphery of said ring and adapted to allow said ring to slidably move generally along the axis of said housing, each of said stabilizer arms having a proximal end connected to said ring, a distal end and an elongate intermediate portion extending between said proximal and distal ends, said intermediate portion having an area less than that of said distal end.

2. A horizontal sidewall sprinkler head according to claim 1, wherein each of said stabilizer arms has inclined upper and lower transitional portions between said intermediate portion and said distal end.

3. A horizontal sidewall sprinkler head according to claim 1, wherein each of said stabilizer arms has curved upper and lower transitional portions between said intermediate portion and said distal end.

4. A horizontal sidewall sprinkler head according to claim 1, wherein each of said stabilizer arms has a generally rectangular shape, and said intermediate portion has an elongate opening.

5. A horizontal sidewall sprinkler head according to claim 1, wherein said stabilizer arms have a generally rectangular cross section, said stabilizer arms having round inner longitudinal edges located adjacent to said deflector.

6. A horizontal sidewall sprinkler head according to claim 1, further comprising a blade member connected to said housing and located above said deflector when said deflector is moved to its extended position.

7. A horizontal sidewall sprinkler head according to claim 6, wherein said deflector has a top recess configured to direct the fire extinguishing liquid toward said blade member after the fire extinguishing liquid is reflected from said deflector.

8. A horizontal sidewall sprinkler head according to claim 6, wherein said blade member includes an upright portion secured to said housing and having upper and lower ends, and a canopy portion generally horizontally extending from the upper end of said upright portion and having a round free edge.

9. A horizontal sidewall sprinkler head according to claim 6, wherein said blade member includes an upright portion secured to said housing and having upper and lower ends, and a canopy portion generally horizontally extending from the upper end of said upright portion and having upwardly bent opposite front corners.

10. A horizontal sidewall sprinkler head according to claim 1, wherein said deflector is secured to said closure member.

11. A horizontal sidewall sprinkler head according to claim 10, wherein said trigger assembly includes a retainer placed in contact with said closure member when said deflector is in its retracted position.

12. A horizontal sidewall sprinkler head according to claim 1, wherein said plurality of parallel guide struts comprises a pair of diametrically opposite guide struts being positioned at opposite sides of said deflector, and wherein said plurality of parallel stabilizer arms comprises a pair of diametrically opposite stabilizer arms being located adjacent to said respective guide struts.

13. A horizontal sidewall sprinkler head according to claim 12, wherein said housing has an annular flange at its one end opposite said inlet opening, said annular flange including a pair of diametrically opposite radial recesses through which said stabilizer arms are moved.

14. A horizontal sidewall sprinkler head comprising:

a tubular body including an inlet opening adapted to communicated with a source of fire extinguishing liquid, an outlet opening and an internal passage extending between said inlet and outlet openings;

a cylindrical frame fluidly connected to said tubular body, said frame having an axis;

a deflector movable between a retracted position wherein said deflector is positioned within said frame and an extended position wherein said deflector is urged out of said frame, said deflector being configured to discharge the fire extinguishing liquid radially outwardly from the axis of said frame when said deflector is moved to its extended position;

a valve member for sealing said outlet opening;

a thermally responsive assembly mounted to said frame to urge said valve member in sealing engagement with said outlet opening, said thermally responsive assembly being activated to release said valve member from said outlet opening when an ambient temperature exceeds a predetermined value; and a deflector guide including a ring movably disposed within said frame and having an outer periphery, a plurality of parallel guide struts axially extending from said ring and adapted to allow said deflector to move generally along the axis of said frame, and a plurality of parallel stabilizer arms axially extending from the outer periphery of said ring and adapted to allow said ring to slidably move generally along the axis of said frame, each of said stabilizer arms having a proximal end connected to said ring, a distal end and an elongate intermediate portion extending between said proximal and distal ends, said intermediate portion being narrower in width than said distal end.

15. A horizontal sidewall sprinkler head according to claim 14, wherein said cylindrical frame has an annular flange at its one end opposite said tubular body, said annular flange being configured to limit outward movement of said ring.

16. A horizontal sidewall sprinkler head according to claim 15, wherein said plurality of parallel guide struts comprises a pair of diametrically opposite guide struts being positioned at opposite sides of said deflector, and wherein said plurality of parallel stabilizer arms comprises a pair of diametrically opposite stabilizer arms being located adjacent to said guide struts.

17. A horizontal sidewall sprinkler head according to claim 16, wherein said annular flange includes a pair of diametrically opposite radial recesses through which said stabilizer arms are moved.

18. A horizontal sidewall sprinkler head according to claim 15, further comprising a substantially L-shaped blade member connected to said flange and located above said deflector when said deflector is moved to its extended position.

* * * * *